US008152152B2

(12) United States Patent
Sakata

(10) Patent No.: US 8,152,152 B2
(45) Date of Patent: Apr. 10, 2012

(54) APPARATUS AND METHOD FOR SEALING PAPER WITH PASTE

(75) Inventor: Kei Sakata, Kinokawa (JP)

(73) Assignee: Duplo Seiko Corporation, Kinakawa-Shi, Wakayama (JP)

( * ) Notice: Subject to any disclaimer, the term of this patent is extended or adjusted under 35 U.S.C. 154(b) by 1 day.

(21) Appl. No.: 12/557,221

(22) Filed: Sep. 10, 2009

(65) Prior Publication Data

US 2011/0057377 A1 Mar. 10, 2011

(51) Int. Cl.
*B65H 37/04* (2006.01)

(52) U.S. Cl. ..... 270/52.18; 270/52.23; 270/52.25; 270/58.07

(58) Field of Classification Search ..... 270/52.23, 270/52.24, 52.25, 52.27, 52.28, 58.07, 52.18, 270/58.08

See application file for complete search history.

(56) References Cited

U.S. PATENT DOCUMENTS 4,066,251 A * 1/1978 Johnsen ..... 270/37
5,492,316 A * 2/1996 Moffa et al. ..... 270/52.24
5,905,935 A * 5/1999 Wakamatsu et al. ..... 399/407
5,980,676 A * 11/1999 Meetze ..... 156/216
6,213,456 B1 * 4/2001 Hirano et al. ..... 270/58.08
6,273,411 B1 * 8/2001 Vijuk ..... 270/37
6,494,661 B1 * 12/2002 Hobbs ..... 412/4
6,863,644 B1 * 3/2005 Cook ..... 493/141
7,014,181 B2 * 3/2006 Walsh et al. ..... 270/52.24

FOREIGN PATENT DOCUMENTS

JP 5-201179 A 8/1993
JP 7-290866 A 11/1995

* cited by examiner

*Primary Examiner* — Patrick Mackey
(74) *Attorney, Agent, or Firm* — Buchanan Ingersoll & Rooney PC

(57) ABSTRACT

An apparatus for sealing paper with paste includes a paper-feeding unit, a pasting main body which seals open ends of a sheet of paper by an adhesive, and a paper-receiving unit on which the sealed sheets of paper are loaded. The pasting main body includes an opening mechanism which opens a closed sheet of paper, an adhesive applying mechanism which applies a peelable temporary adhesive in a streaky form to a lower folded piece of the opened sheet of paper, a sealing mechanism which superposes an upper folded piece on the lower folded piece, and which temporarily adheres the open ends of the upper and lower folded pieces, and a conveying mechanism.

7 Claims, 18 Drawing Sheets

Right
Left
Front
F
2
11
12
13
15
30
30a
32
33
33a
34
35
36
36a
37
38
39
45
P
P1
P2,P3

APPARATUS AND METHOD FOR SEALING PAPER WITH PASTE

BACKGROUND OF THE INVENTION

1. Field of the Invention

The present invention relates to an apparatus and a method for sealing a folded sheet of paper with paste using an adhesive.

2. Description of the Related Art

Direct mail is an advertising method that has rapidly become widespread due to a convenience of being sent to an individual target person utilizing reliability of postal mail. In recent years, however, since many corporations and stores utilize the direct mails, each house receives several to several tens of direct mails a day in some cases.

In the case of the sealed direct mail, since it is troublesome to open every envelope, there is a tendency that many receivers discard the envelopes without opening them. When senders such as corporations send sealed direct mail, since they also enclose greetings, catalogs or reply cards in the envelopes, there is a problem that costs of the catalogs and operation costs for enclosing these sheets of paper become expensive.

In addition to the direct mail that is sent in the sealed state as described above, recently, there are direct mail and information concealing postcards which are directly mailed without being put into envelopes and in which folded pieces of folded sheets of paper are adhered to each other by means of pressure-sensitive pseudo-adhesive such that they can peel off from each other if a predetermined pressure is applied thereto (Japanese Patent Application Laid-open No. H5-201179). The folded sheet of paper can be mailed as mail as it is at a normal postcard fee, and a receiver thereof can easily check its contents by peeling the both folded pieces off. That is, this is advantageous in terms of costs as compared with a case where a sheet of paper is sent in an envelope, and this is convenient for both sender and receiver.

When advertisements or catalogs in which it is unnecessary to conceal information are sent by direct mail, there is a way to fold the advertisement or the catalog, and they are sealed by means of an adhesive tape to save a receiver the trouble of opening the sealed letter (Japanese Patent Application Laid-open No. H7-290866). In this case, the receiver can read contents in the direct mail only by merely peeling off the tape, it is possible to expect to prevent wasteful dust from being generated, and since the sealed letter is not used, operation of putting letters into envelopes becomes unnecessary.

According to the direct mail or the information concealing postcards of Japanese Patent Application Laid-open No. H5-201179, an adhesive is previously applied to an entire surface of a folded piece, an entire surface of a folded surface is pressed by a roller that presses the entire surface of the folded surface to adhere the folded surface. Therefore, an application processing apparatus is required for an entire paper, and the roller for pressing the entire surface of the folded piece is necessary, a machine is increased in size and weight.

According to the direct mail of Japanese Patent Application Laid-open No. H7-290866, a seal becomes a cause of increasing costs, and although a machine for automatically pasting the seal to an open end of a folded sheet of paper is developed, there is a problem that its processing speed is slow.

SUMMARY OF THE INVENTION

It is an object of the present invention to provide an apparatus and a method for sealing a folded sheet of paper such as direct mail with paste capable of automatically and swiftly sealing an open end of a folded sheet of paper without subjecting an entire surface of the sheet of paper to the adhesive application processing in advance, in which a receiver can easily check contents of the mail without carrying out an opening operation or a cutting and opening operation of perforations.

To achieve the above object, the present invention provides an apparatus for sealing paper with paste which seals folded pieces of a folded sheet of paper by an adhesive, including a paper-feeding unit on which folded sheets of paper are loaded and which supplies the sheets of paper one-sheet by one-sheet, a pasting main body which seals open ends of the sheet of paper supplied from the paper-feeding unit by means of an adhesive, and a paper-receiving unit on which sealed sheets of paper discharged from the pasting main body are loaded, wherein the pasting main body includes an opening mechanism which opens the closed sheet of paper in the vertical direction, an adhesive applying mechanism which applies, in a streaky form, a peelable temporary adhesive to an upper surface of an open end of a lower folded piece of the opened sheet of paper, a sealing mechanism which superposes an upper folded piece on the lower folded piece after application of the temporary adhesive, and which temporarily adheres open ends of the upper and lower folded pieces, and a conveying mechanism which conveys a sheet of paper from the opening mechanism to the sealing mechanism through the adhesive applying mechanism.

According to the apparatus for sealing paper with paste having the above-described structure, the open ends of the upper and lower folded pieces of a double-folded or triple-folded sheet of paper can be sealed to each other automatically and swiftly by the temporary adhesive. Therefore, direct mail that can be utilized as mail like an envelope can easily and continuously be produced, and material costs and operation costs required for putting letters into envelope can be reduced. Further, when the direct mail is produced, a receiver can easily see contents of the mail only by opening the open ends which are sealed by the temporary adhesive without using a pair of scissors or the like.

In the apparatus for sealing paper with paste of the present invention, the opening mechanism preferably includes an upper suction portion which sucks the upper folded piece upward, and a lower suction portion which sucks the lower folded piece downward.

According to this structure, it is possible to reliably open the open ends of the upper and lower folded pieces without damaging the sheet of paper.

In the present invention, preferably, the upper suction portion is a suction box provided at its lower surface with a suction port, and the lower suction portion is an air-suction type belt conveying mechanism having a suction box provided at its upper surface with a suction port.

According to this structure, it is possible to open the open ends of the upper and lower folded pieces without damaging a sheet of paper while conveying the sheet of paper, and the efficiency of the opening operation is enhanced.

In the present invention, preferably, the upper suction portion is an air-suction type belt conveying mechanism having a suction box provided at its lower surface with a suction port, and the lower suction portion is an air-suction type belt conveying mechanism having a suction box provided at its upper surface with a suction port.

According to this structure, since the upper and lower folded pieces are conveyed by the air-suction type belt conveying unit, it is possible to reliably keep the attitude of a sheet of paper at a predetermined attitude, and to convey the sheet of paper.

In the present invention, preferably, the apparatus for sealing paper with paste further includes an expansion guide member which guides the upper folded piece of the sheet of paper opened by the opening mechanism to the adhesive applying mechanism such that an opening degree of the folded piece is expanded, and a sealing guide member which guides, to the lower folded piece, the upper folded piece of a sheet of paper after the temporary adhesive is applied by the adhesive applying mechanism.

According to this structure, the upper and lower folded pieces can be adhered to each other with a precise mutual positional relation without generating a wrinkle, a deviation or unnecessary bend.

In the present invention, preferably, a folder which folds a non-folded sheet of paper and supplies the sheet of paper to the paper-feeding unit is connected to the paper-feeding unit.

According to this structure, the operation of folding a non-folded sheet of paper and the pasting operation can be carried out continuously and automatically, and the operation efficiency from the non-folded state can further be enhanced.

In the present invention, preferably, the folder includes an adhesive applying mechanism which applies, in a streaky form, a peelable temporary adhesive to an end of a non-folded sheet of paper in a direction of a bend line.

According to this structure, not only the open end of a folded sheet of paper but also both ends of the sheet of paper in a direction of a bend line can be sealed by a temporary adhesive. Therefore, it is possible to seal the entire periphery of the folded sheet of paper by the temporary adhesive, and the present invention is suitable for producing mail on which information that should be concealed is described.

The present invention also provides a method for sealing paper with paste for sealing folded pieces of a folded sheet of paper by an adhesive, including the steps of: vertically opening open ends of a folded sheet of paper by an opening mechanism, applying a peelable temporary adhesive to the open end of the lower folded piece of the opened sheet of paper by an adhesive applying mechanism, and superposing the upper folded piece on the lower folded piece after the temporary adhesive is applied, and temporarily adhering the open ends of the upper and lower folded pieces by a sealing mechanism.

According to the method for sealing paper with paste, substantially the same effect obtained by the apparatus for sealing paper with paste can be obtained.

DETAILED DESCRIPTION OF THE PREFERRED EMBODIMENTS

[Folded Sheet of Paper Pasted by an Apparatus and a Method For Sealing Paper With Paste According to the Present Invention]

Figure 1:
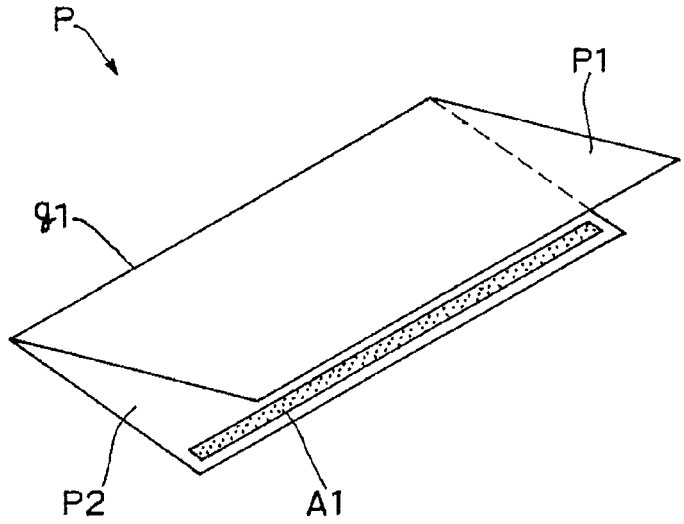
FIG. 1 is a perspective view of a double-folded sheet of paper that are sealed with paste by an apparatus and a method of the present invention.
Figure 2:
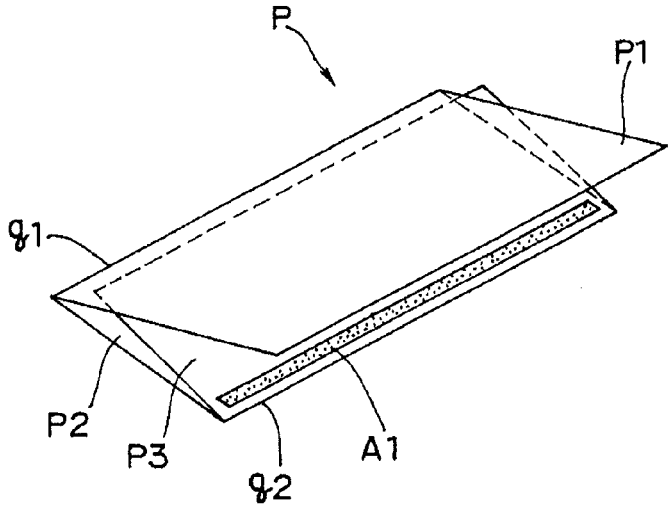
FIG. 2 is a perspective view of an inwardly triple-folded sheet of paper that are sealed with paste by the apparatus and the method of the present invention.
Figure 3:
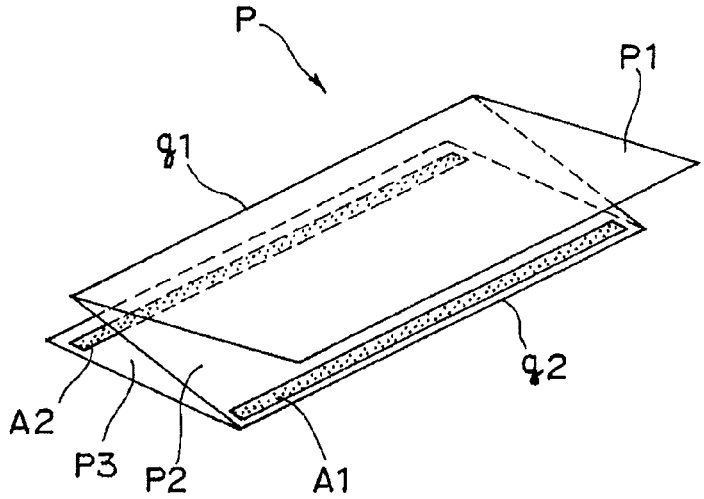
FIG. 3 is a perspective view of an outwardly (Z-shaped) triple-folded sheet of paper that are sealed with paste by the apparatus and the method of the present invention.

FIGS. 1 to 3 show an example of folded sheets of paper that are pasted by an apparatus and a method of the present invention. FIG. 1 shows a double-folded sheet of paper P folded along the one bend line q1. The sheet of paper P includes a first folded piece P1 and a second folded piece P2, a temporary adhesive A1 is applied to an upper surface of an open end of the lower second folded piece P2 in a streaky form parallel to the bend line q1, the open ends of upper first folded piece P1 and the lower folded piece P2 are adhered to each other by the temporary adhesive A1 such that they can be peeled off from each other.

FIG. 2 shows a sheet of paper P that is inwardly triple-folded along two parallel bend lines q1 and q2, and the sheet of paper P has first, second and third folded pieces P1, P2 and P3. Third folded piece P3 is folded on the upper side of second folded piece P2 along second bend line q2, and first folded piece P1 is folded on the upper side of third folded piece P3 along first bend line q1. The temporary adhesive A1 is applied to an upper surface of an open end of the third folded piece P3 with respect to the first folded piece P1 in a streaky form parallel to the second folded piece P2. An open end of the upper first folded piece P1 is adhered to the third folded piece P3 by the temporary adhesive A1 such that they can be peeled off from each other.

FIG. 3 shows a sheet of paper P that is triple-folded into a Z-shape along two parallel bend lines q1 and q2, and the sheet of paper P includes first, second and third folded pieces P1, P2 and P3. The third folded piece P3 is folded on the lower side of the second folded piece P2 along the second bend line q2, and the first folded piece P1 is folded on the upper side of the second folded piece P2 along the first bend line q1. Temporary adhesives A1 and A2 are applied in a streaky form to an upper surface of an open end of the second folded piece P2 with respect to the first folded piece P1 and an upper surface of an open end of the third folded piece P3 with respect to the second folded piece P2 in parallel to the bend lines q1 and q2, and the open ends are adhered to each other through the temporary adhesives A1 and A2 such that they can be peeled off from each other.

Embodiments of the Present Invention (Structure of Entire Apparatus for Sealing Paper With Paste)

FIGS. 4 to 13 show a first embodiment of the apparatus for sealing paper with paste according to the present invention. This apparatus is used for pasting folded sheets of paper shown in FIGS. 1 and 2. The first embodiment of the present invention will be explained based on these drawings.

Figure 4:
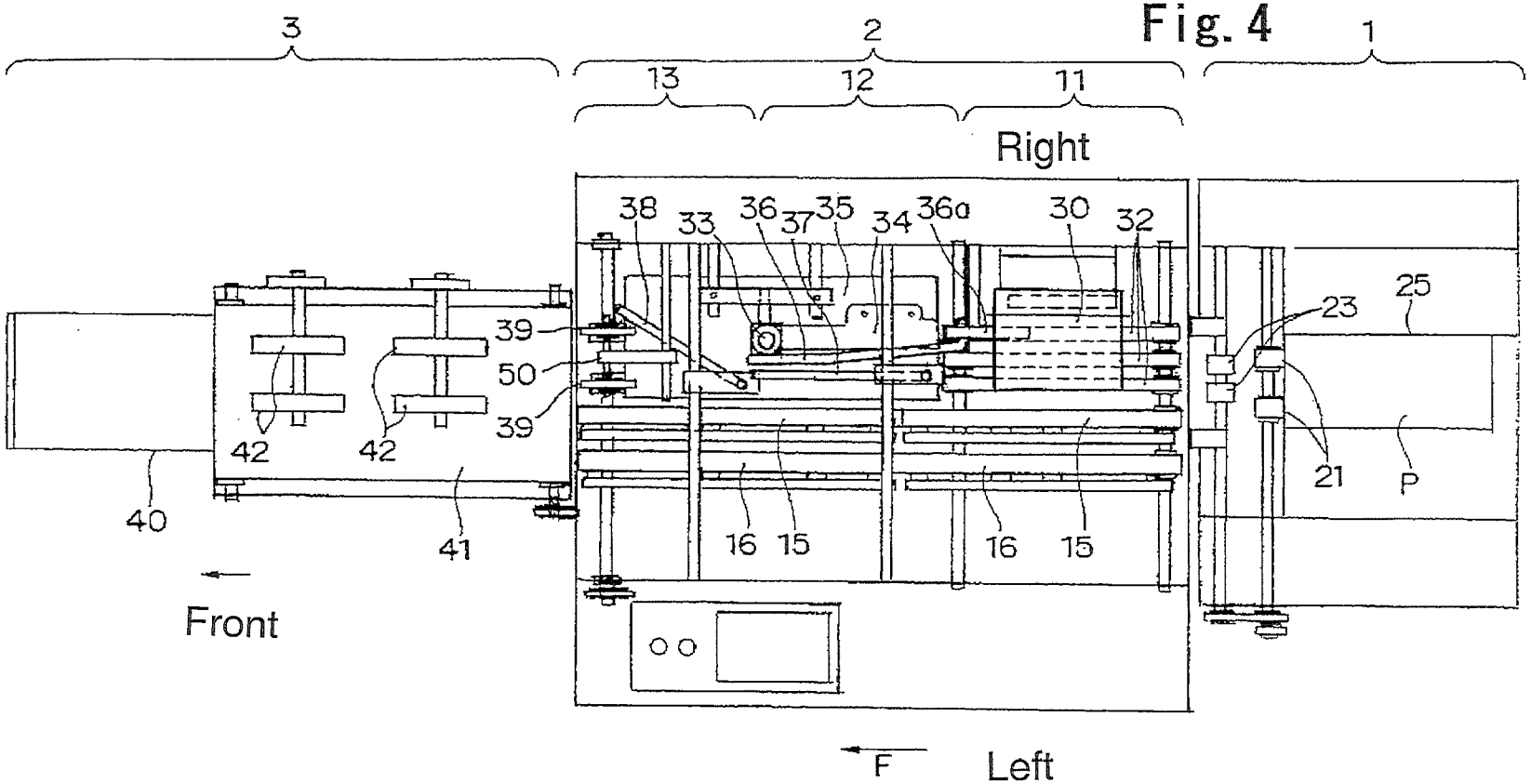
FIG. 4 shows a first embodiment of the present invention, and is a plan view of an entire apparatus for sealing paper with paste.
Figure 5:
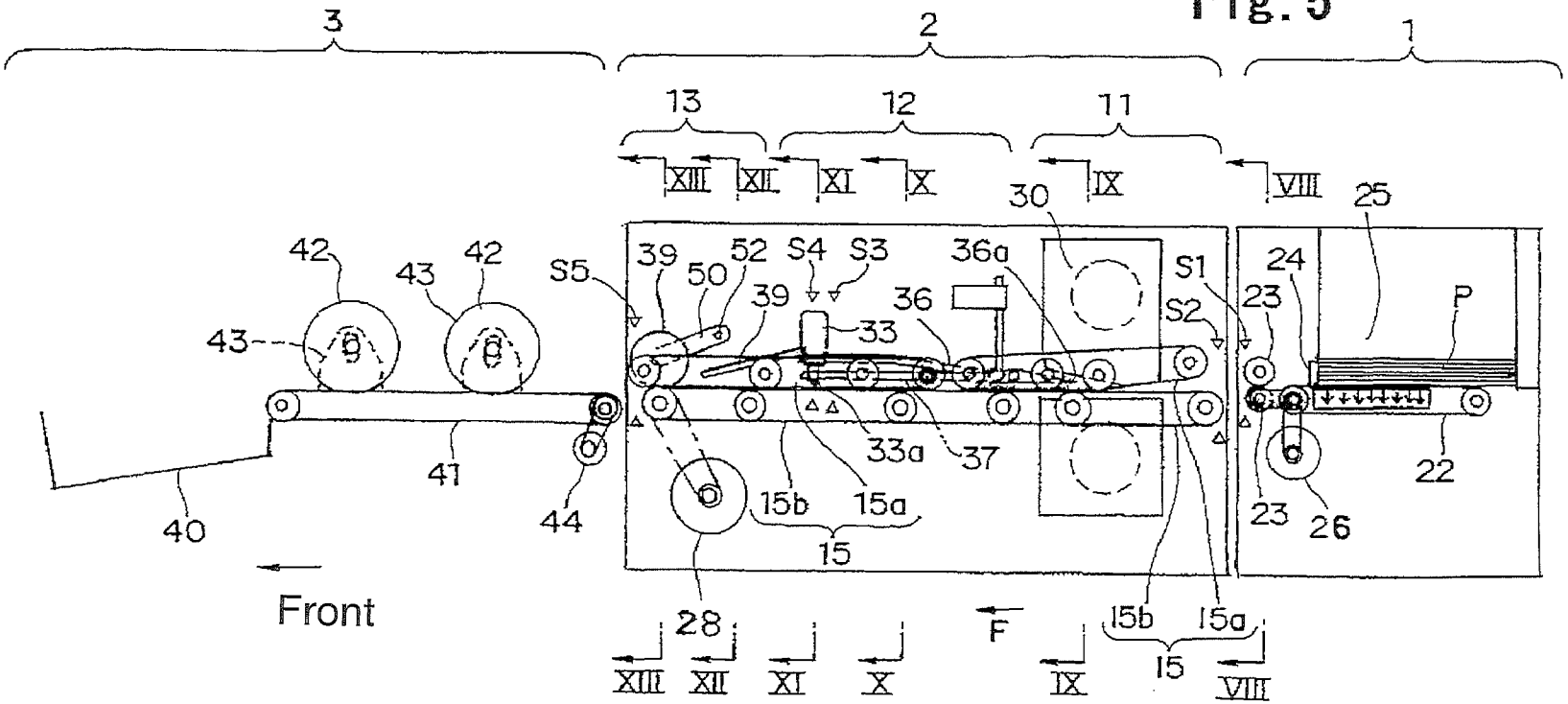
FIG. 5 is a front view of FIG. 4.

FIG. 4 is a plan view of the entire apparatus for sealing paper with paste. FIG. 5 is a front view of the entire apparatus for sealing paper with paste. In FIG. 4, the apparatus for sealing paper with paste includes a paper-feeding unit 1, a pasting main body 2 and a paper-receiving unit 3 in this order from upstream of a paper conveying direction F. In the following description, for the sake of convenience, the downstream side of the conveying direction F is defined as a front side of the apparatus for sealing paper with paste, and left and right sides when viewing conveying direction F from its upstream toward its downstream are defined as left and right sides of the apparatus for sealing paper with paste.

Provided in the pasting main body 2 sequentially from the upstream of the conveying direction F, i.e., from a rear side of the pasting main body 2 are an opening mechanism 11 which opens a closed sheet of paper in the vertical direction, an adhesive applying mechanism 12 which expands the open states of opened upper and lower folded pieces and which applies a peelable temporary adhesive to the lower folded piece in a streaky form, a sealing mechanism 13 which superposes the upper folded piece on the lower folded piece and temporarily adheres open ends of the upper and lower folded pieces to each other, and a main conveying mechanism 15 and an auxiliary conveying mechanism 16 which convey the sheets of paper along left sides of the opening mechanism 11, the adhesive applying mechanism 12 and the sealing mechanism 13.

The opening mechanism 11 of the pasting main body 2 includes a suction box 30 disposed on an upper side of a conveying passage, and an air-suction type belt conveying mechanism 32 disposed on a lower side of the conveying passage. The adhesive applying mechanism 12 includes a applying nozzle 33 which applies the temporary adhesive, a pair of upper and lower guide plates 34 and 35 which guides the lower folded piece of the paper, and a pair of left and right guide rods (expansion guide members) 36 and 37 which guides the upper folded piece of the paper. The sealing mechanism 13 includes a sealing guide rod (sealing guide member) 38 which guides the upper folded piece downward, and a pressing roller 39 which brings the upper folded piece into contact with the lower folded piece under pressure.

In FIG. 5, the paper-feeding unit 1 includes an air-suction type belt conveying mechanism 22 on which a large number of folded sheets of paper P are loaded, a pair of upper and lower paper-feeding rollers 23 disposed in front of the air-suction type belt conveying mechanism 22, and an aligning member 24 disposed in a lower end opening of a paper front end restricting plate which stands on the air-suction type belt conveying mechanism 22. The air-suction type belt conveying mechanism 22 and the paper-feeding rollers 23 are interlocked to a paper-feeding first drive motor 26 through a transmission mechanism. That is, the sheets of paper P are forwardly sent out from the lowest one-sheet by one-sheet by the air-suction type belt conveying mechanism 22 and the aligning member 24, and the sheets of paper P are supplied to pasting main body 2 by paper-feeding rollers 23. the paper-feeding unit 1 is provided with a position restricting plate 25 for aligning right ends of the loaded sheets of paper P with a predetermined position.

The main conveying mechanism 15 of the pasting main body 2 includes a pair of upper and lower belt conveying units 15*a* and 15*b*. The lower belt conveying unit 15*b* is interlocked to a conveying second drive motor 28 through a transmission mechanism. The upper belt conveying unit 15*a* is operated together with the lower belt conveying unit 15*b* in synchronization with through an appropriate interlocking mechanism (not shown), left ends of sheets of paper are sandwiched between the upper and lower belt conveying units 15*a* and 15*b*, and the sheets of paper are conveyed forward (in the conveying direction F).

The paper-receiving unit 3 includes a belt conveying mechanism 41 and a paper-receiving tray 40 in this order from a rear side of the paper-receiving unit 3. The belt conveying mechanism 41 is interlocked to a paper-receiving third drive motor 44 through a transmission mechanism. A pair of front and rear metal auxiliary pressure rollers 42 is disposed on an upper side of the belt conveying mechanism 41. Auxiliary pressure rollers 42 are vertically movably supported by a bracket 43. A paper conveying speed V3 of the belt conveying mechanism 41 of the paper-receiving unit 3 is set smaller than a paper conveying speed V1 of the main transfer mechanism 15 of the pasting main body 2. With this, the sheets of paper which are continuously discharged from the pasting main body 2 after the pasting operation are conveyed on the belt conveying mechanism 41 of the paper-receiving unit 3 in a partially superposed state, i.e., a scale-like superposed state, and the sheets of paper are finally pressed by the auxiliary pressure rollers 42 in this scale-like superposed state.

(Detailed Structure of Opening Mechanism 11)

Figure 6:
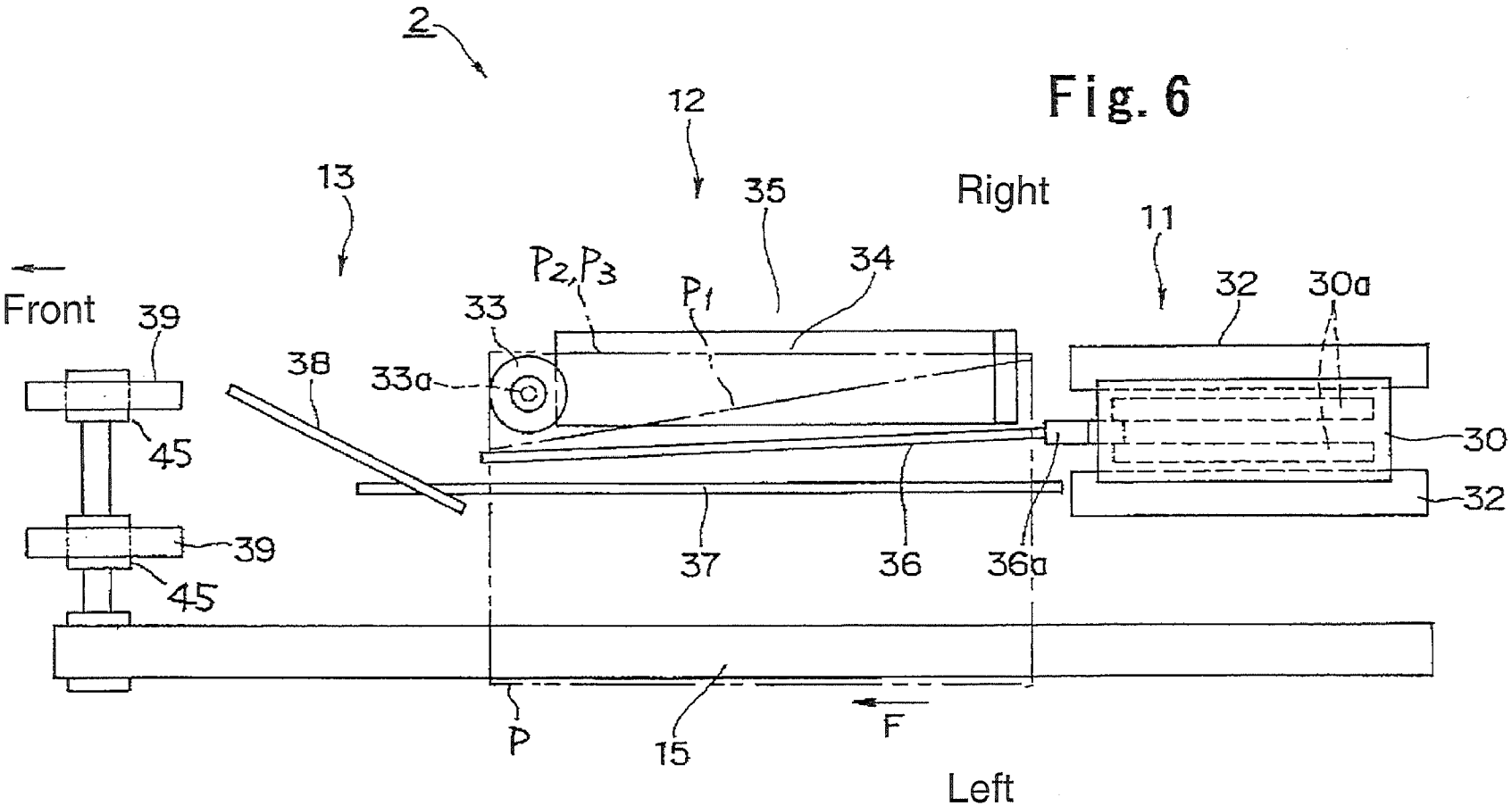
FIG. 6 is an enlarged plan view of a pasting main body of the apparatus for sealing paper with paste shown in FIG. 4.
Figure 7:
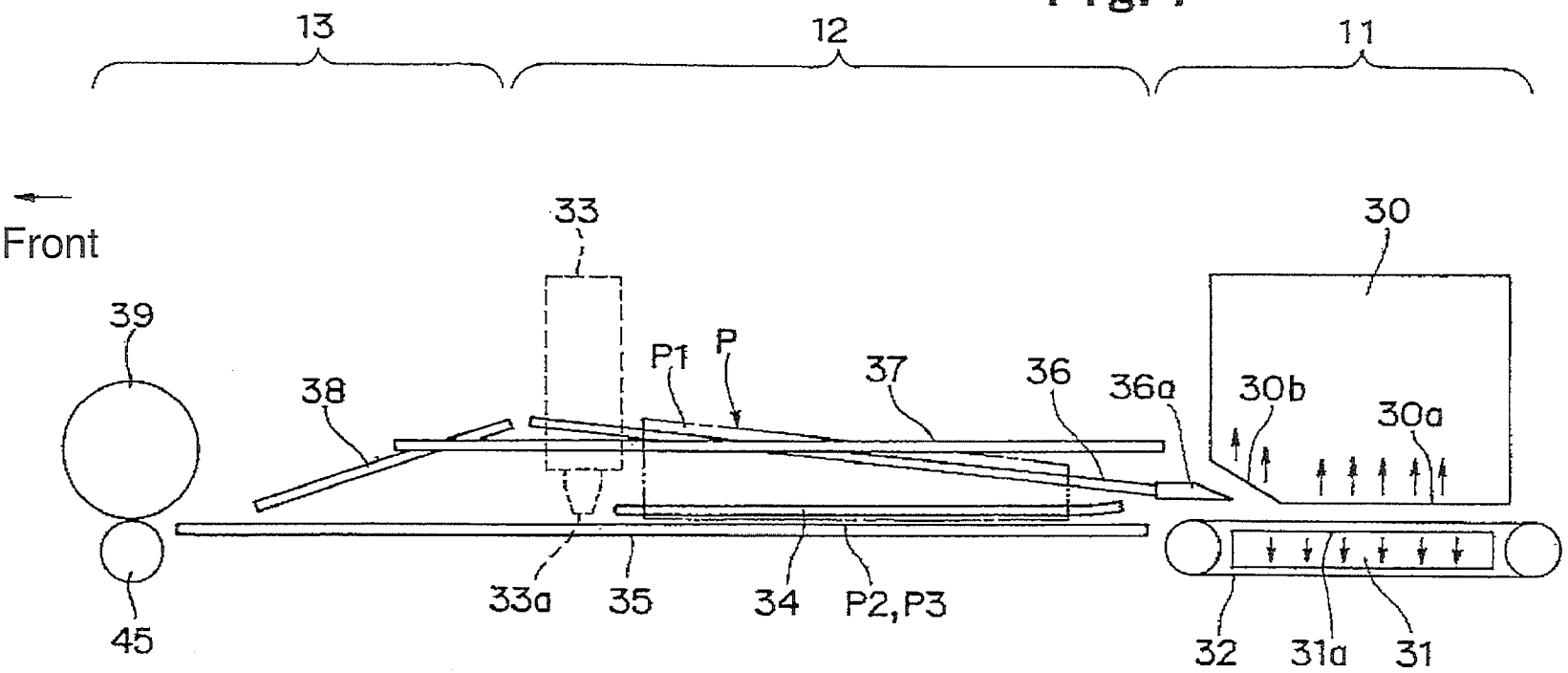
FIG. 7 is a front view of FIG. 6.

FIG. 6 is an enlarged plan view showing essential constituent elements of the pasting main body 2. FIG. 7 is a front view of FIG. 6. FIGS. 8 to 13 show a pasting operation of the folded sheets of paper in the order of steps, and correspond to enlarged sectional views taken along the line VIII-VIII, the line IX-IX, the line X-X, the line XI-XI, the line XII-XII and the line XIII-XIII in FIG. 5, respectively.

In FIG. 7, the opening mechanism 11 includes the suction box 30 disposed on the upper side of the conveying passage, and the air-suction type belt conveying mechanism 32 having a suction box 31 disposed on the lower side of the conveying passage. A front portion of a lower surface of the upper suction box 30 has an inclined surface 30*b* which is oriented forward and opens upward.

Figure 9:
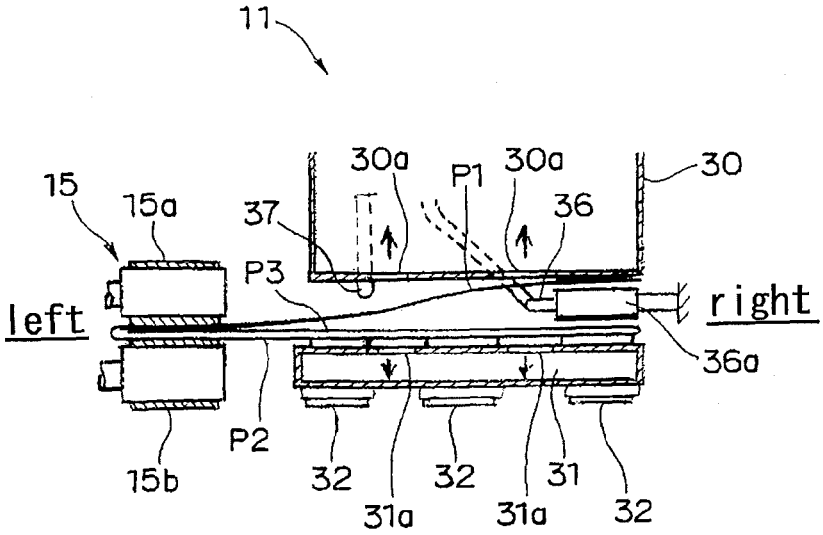
FIG. 9 is a sectional view taken along the line IX-IX in FIG. 5 showing an opening step of a sheet of paper.

In FIG. 9, a pair of right and left suction holes 30*a* is formed in a lower surface of the upper suction box 30. The suction holes 30*a* extend in a longitudinal direction and formed in a rectangular shape, and upwardly suck the upper first folded piece P1 of the sheet of paper P. The pair of right and left suction holes 31*a* is formed in an upper surface of the suction box 31 of the lower air-suction type belt conveying mechanism 32 in correspondence with the suction holes 30*a* of the upper suction box 30. The suction holes 31*a* extend in the longitudinal direction in a rectangular shape. The suction holes 31*a* suck the lower folded piece P2 of the sheet of paper P and convey the sheet of paper forward. Three conveying belts are disposed in the lower air-suction type belt conveying mechanism 32 at a distance from one another in a lateral direction, and the suction holes 31*a* and 30*a* are located between the conveying belts.

(Detailed Structure of the Adhesive Applying Mechanism 12)

In FIG. 6, the applying nozzle 33 is disposed at a front end of the adhesive applying mechanism 12, and a lower end discharge port 33*a* thereof is disposed from above at a location corresponding to a right end of the lower folded piece of a sheet of paper P which is being conveyed.

In FIG. 7, the upper and lower guide plates 34 and 35 which guide the lower folded pieces (P2, P3 and the like) of the sheet of paper P are disposed substantially horizontally at a predetermined distance from each other in a vertical direction, and the guide plates 34 and 35 are set substantially at a same height as an upper end conveying surface of the belt conveying mechanism 32 of the opening mechanism 11. The lower guide plate 35 extends rearward from a position near a front end of the belt conveying mechanism 32 of the opening mechanism 11, passes through a location below the applying nozzle 33 and reaches a location near the pressing roller 39 of the sealing mechanism 13. The upper guide plate 34 extends rearward from a location near the front end of the belt conveying mechanism 32 of the opening mechanism 11, and discontinues at a location slightly behind the lower end discharge port 33*a* of the applying nozzle 33.

The first guide rod 36 that is right one of the right and left guide rods 36 and 37 which guide the upper folded piece P1 is integrally provided at its rear end with a wedge-like separating pawl 36*a*. The separating pawl 36*a* is disposed between the front inclined surface 30*b* of the upper suction box 30 of the opening mechanism 11 and the lower belt conveying mechanism 32. The right first guide rod 36 diagonally extends forwardly and upwardly from the separating pawl 36*a* and reaches a left side of the applying nozzle 33. A rear end of the left second guide rod 37 is located higher than the separating pawl 36*a*, extends forward substantially horizontally, reaches a left side of the applying nozzle 33 and further extends forward. The guide rods 36 and 37 have circular cross sections and are made of stainless steel or aluminum steel so that the guide rods can smoothly guide sheets of paper.

(Detailed Structure of the Sealing Mechanism 13)

In FIG. 7, a rear end of the sealing guide rod 38 of the sealing mechanism 13 is located near the left side of the applying nozzle 33, and is located above a front end of the second guide rod 37 of the adhesive applying mechanism 12, and a rear end thereof diagonally extends rightward, forward and downward and reaches a location near a lower end of the pressing roller 39. In FIG. 6, a front end of sealing guide rod 38 extends rightward to a substantially same location as a location of the applying nozzle 33 in the lateral direction as viewed from above, and reaches a location near the pressing roller 39.

Figure 13:
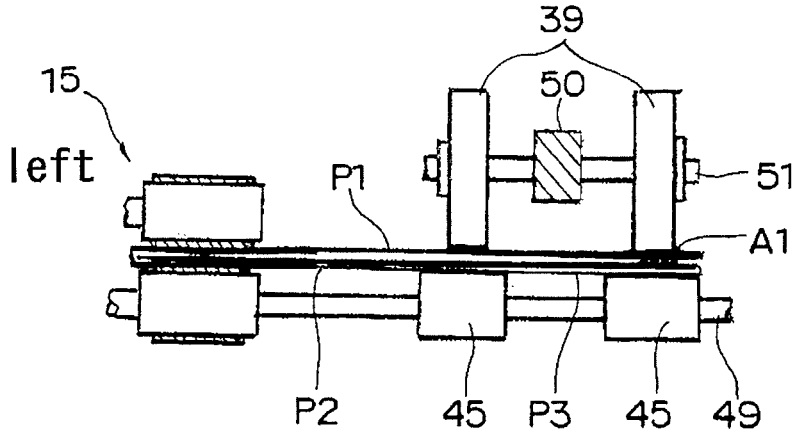
FIG. 13 is a sectional view taken along the line XIII-XIII in FIG. 5 showing a pressing stage of the sealing step of a sheet of paper.

In FIG. 13, the right and left pressing rollers 39 are made of metal so that they have predetermined weights. The pressing rollers 39 are turnably supported by a front end of a rocker arm 50 through a turning shaft 51. The pair of rubber rollers 45 each having a smaller diameter than that of the pressing roller 39 is provided below the pressing rollers 39. The each rubber roller 45 is fixed to a drive shaft 49 of the main transfer mechanism 15 and rotates in synchronization with the main transfer mechanism 15.

As shown in FIG. 5, a rear end of the rocker arm 50 is turnably supported by a support shaft 52. With this, the pressing roller 39 can be moved vertically, and the sheet of paper P is pressurized from above by a weight of the pressing roller 39 of its own.

(Paper Detection Sensor)

In FIG. 5, paper detection sensors are disposed in the apparatus for sealing paper with paste at a plurality of locations. For example, first and second paper detection sensors S1 and S2 of light transmission type are disposed between the paper-feeding rollers 23 of the paper-feeding unit 1 and a rear end of the main transfer mechanism 15 of the pasting main body 2, a fourth paper detection sensor S4 which detects a front end of the sheet of paper and emits an application-starting signal of an adhesive, and a third paper detection sensor S3 of a light transmission type which detects a rear end of the sheet of paper and emits an application-completing signal of the adhesive are disposed near the applying nozzle 33 of the adhesive applying mechanism 12. A fifth paper detection sensor S5 of a light transmission type is disposed between the sealing mechanism 13 and the paper-receiving unit 3. The third and fourth paper detection sensors S3 and S4 emit an application-starting signal and an application-completing signal of the adhesive by the applying nozzle 33. The other sensors S1, S2 and S5 are used mainly for detecting a paper jam.

(Function)

A flow of operation when the inwardly triple-folded sheet of paper P as shown in FIG. 2 is pasted by the apparatus for sealing paper with paste shown in FIGS. 1 to 7 will be explained.

(1) Paper Feeding Step

Figure 8:
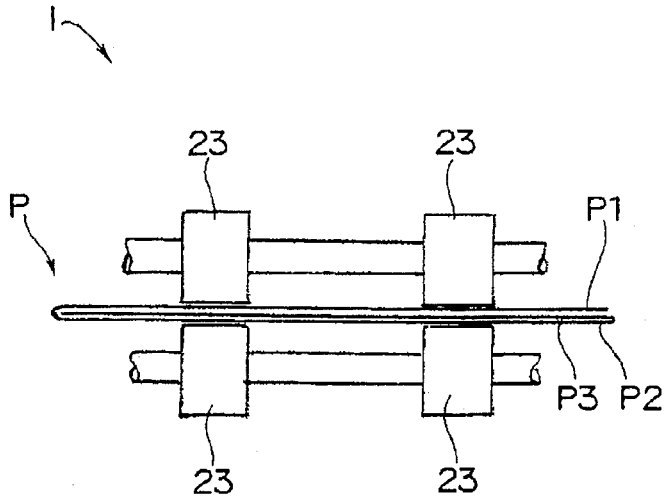
FIG. 8 is a sectional view taken along the line VIII-VIII in FIG. 5 showing a paper feeding step of a sheet of paper.

In FIG. 5, a large number of inwardly triple-folded sheets of paper P (shown in FIG. 2) are loaded on the air suction type belt conveying mechanism 22 of the paper-feeding unit 1, a lowest sheet of paper P is sent out forward by operations of the air-suction type belt conveying mechanism 22 and aligning member 24, the sheet of paper P is sandwiched between the upper and lower paper-feeding rollers 23 as shown in FIG. 8, and the sheet of paper P is supplied forward in a substantially horizontal closed state (flat surface state).

(2) Opening Step

In FIG. 9, a left end of the sheet of paper P supplied to the opening mechanism 11 in the substantially horizontal closed state is sandwiched between the upper and lower belt conveying units 15*a* and 15*b* of the main conveying mechanism 15, and the sheet of paper P is conveyed forward. During this conveying operation, the lower second folded piece P2 is sucked downward by the lower suction box 31, and the intermediate third folded piece P3 is maintained in a state where it is substantially superposed on an upper surface of the second folded piece P2 by its own weight. The upper first folded piece P1 is sucked upward by the upper suction box 30, and is separated upward from the lower second and third folded pieces P2 and P3. That is, the closed state of sheet of paper P is changed to a state where its right end is opened. The, opened sheet of paper P is mechanically separated into the upper first folded piece P1 and the lower second and third folded pieces P2 and P3 by the tip end separating pawl 36*a* of the first guide rod 36.

(3) Opening/Expanding Step

Figure 10:
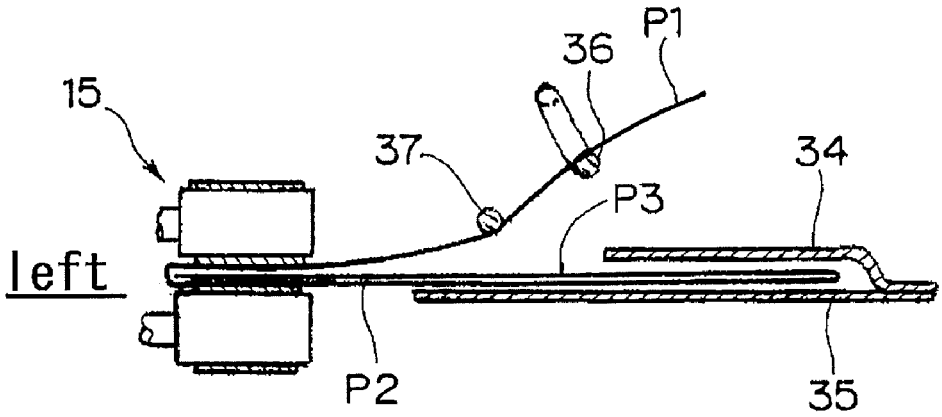
FIG. 10 is a sectional view taken along the line X-X in FIG. 5 showing an opening/expanding step of a sheet of paper.

In FIG. 10, when the sheet of paper P is moved to the adhesive applying mechanism 12, the lower second and third folded pieces P2 and P3 enter a gap between the lower guide plates 34 and 35, they are maintained in a substantially horizontal state and are conveyed. A right end of the upper first folded piece P1 is gradually pushed up from a lower side by the right first guide rod 36, and an upward movement of a portion between the first guide rod 36 and the main conveying mechanism 15 is restricted by substantially horizontal the left second guide rod 37. With this, a right half of the upper first folded piece P1 gradually rises and approaches its vertical attitude. That is, an opening degree thereof is expanded.

(4) Application Step

Figure 11:
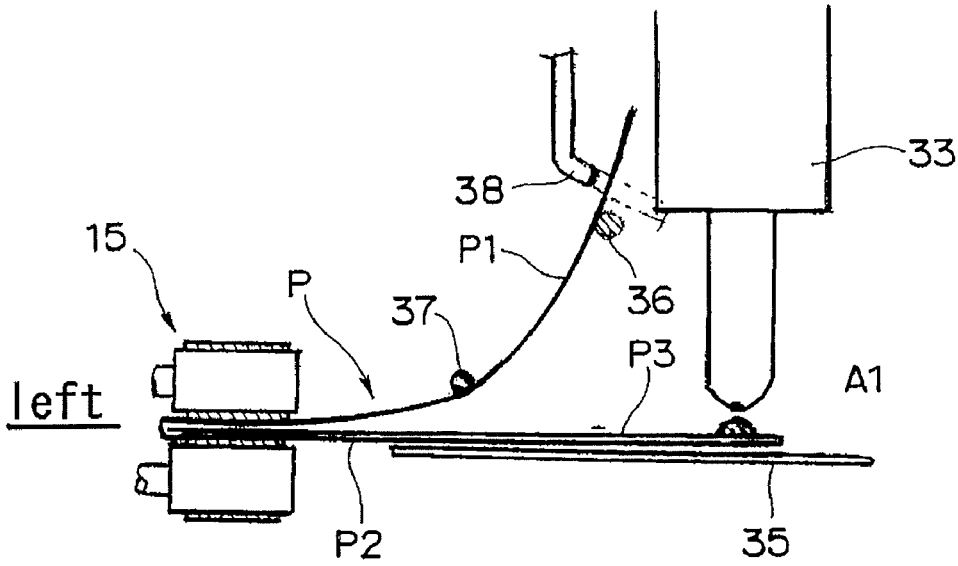
FIG. 11 is a sectional view taken along the line XI-XI in FIG. 5 showing an adhesive applying step.

In FIG. 11, when the sheet of paper P reaches a position corresponding to the applying nozzle 33, the upper guide plate 34 discontinues and an upper surface of the third folded piece P3 is exposed. At that time, the first folded piece P1 rises to a state where it does not interfere with the applying nozzle 33. A temporary adhesive is discharged from the lower end discharge port 33*a* of the nozzle and the sheet of paper P is conveyed forward in this state, and the temporary adhesive A1 is applied to a right end of an upper surface of the third folded piece P3 in a streaky form parallel to the conveying direction F.

Concerning application-starting timing and application-completing timing by the applying nozzle 33, as explained with reference to FIG. 5, the application is started when a front end of the sheet of paper P is detected by the fourth sensor S4, and the application is completed when a rear end of the sheet of paper P is detected by the third sensor S3. With this, the peelable temporary adhesive A1 is applied to substantially the entire width of the sheet of paper P in the longitudinal direction in a streaky form as shown in FIG. 2.

(5) Sealing Step

Figure 12:
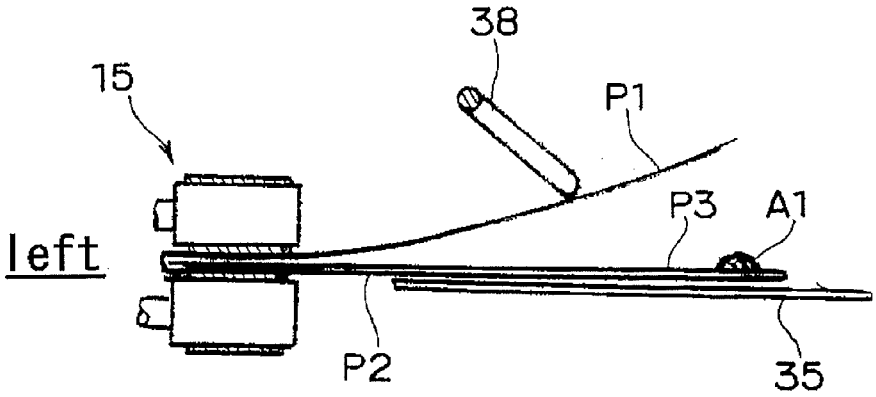
FIG. 12 is a sectional view taken along the line XII-XII in FIG. 5 showing a preliminary stage of a sealing step of a sheet of paper.

After the temporary adhesive A1 is applied in FIG. 11, the upper first guide piece P1 is guided downward toward the third folded piece P3 by the sealing guide rod 38 of the sealing mechanism 13 as shown in FIG. 12 simultaneously when a position restriction by the expansion first and second guide rods 36 and 37 is released.

In FIG. 13, after the first folded piece P1 is superposed on the upper surface of the third folded piece P3, the sheet of paper P is sandwiched between the metal pressing roller 39 and the rubber roller 45. An application portion of the temporary adhesive A1 is directly pressurized by the right pressing roller 39, a right open end of the sheet of paper P is reliably temporarily adhered such that it can be peeled off. Material of pressing roller 39 is not limited to metal, and the pressing roller may be made of resin.

In FIG. 5, while the sheet of paper P reaches the sealing mechanism 13 from the opening mechanism 11, the sheet of paper P is conveyed at the predetermined conveying speed V1 by the main transfer mechanism 15.

(6) Loading Step

In FIG. 5, after the sheet of paper P is sealed, the sheet of paper P discharged onto the belt conveying mechanism 41 of the paper-receiving unit 3 is superposed on the belt conveying mechanism 41 in a scale form because the conveying speed V3 of the belt conveying mechanism 41 is set smaller than the conveying speed V1 of the main transfer mechanism 15 of the pasting main body 2, the adhered portion is finally pressurized by the auxiliary pressure rollers 42, the sheets of paper P are aligned and superposed on the paper-receiving tray 40.

(7) Effect

The folded sheets of paper P can automatically and continuously be sealed by the temporary adhesive such that they can be peeled off.

(8) The auxiliary conveying mechanism 16 disposed in parallel to the main conveying mechanism 15 is disposed only on the lower side of the conveying passage, and when the lateral width of the sheet of paper P to be pasted is large, a paper portion protruding leftward from the main conveying mechanism 15 is supported from below, and the sheet of paper P is conveyed at the same speed as the main conveying mechanism 15. With this, deformation of the sheet of paper P during conveyance is prevented and the sheet of paper P is conveyed in a stable state.

(Pasting Operation of Different Kinds of Sheets of Paper)

(1) When double-folded sheets of paper P as shown in FIG. 1 are to be pasted also, they can be pasted continuously by the apparatus for sealing paper with paste shown in FIGS. 1 to 7 like the sheets of paper shown in FIG. 2.

(2) In the case of triple-folded sheets of paper P in the form of Z-shape as shown in FIG. 3, the apparatus for sealing paper with paste shown in FIGS. 1 to 7 can not apply the adhesives A1 and A2 at two locations by one operation. However, after open ends of first folded piece P1 and second folded piece P2 shown in FIG. 3 are once temporarily adhered to each other through the temporary adhesive A1, when the sheet of paper is returned from the paper-receiving unit 3 to the paper-feeding unit 1 in the vertically reversed attitude, the open ends of the second folded piece P2 and the third folded piece P3 can be temporarily adhered to each other by the temporary adhesive A2 by the second operation.

Second Embodiment

Figure 14:
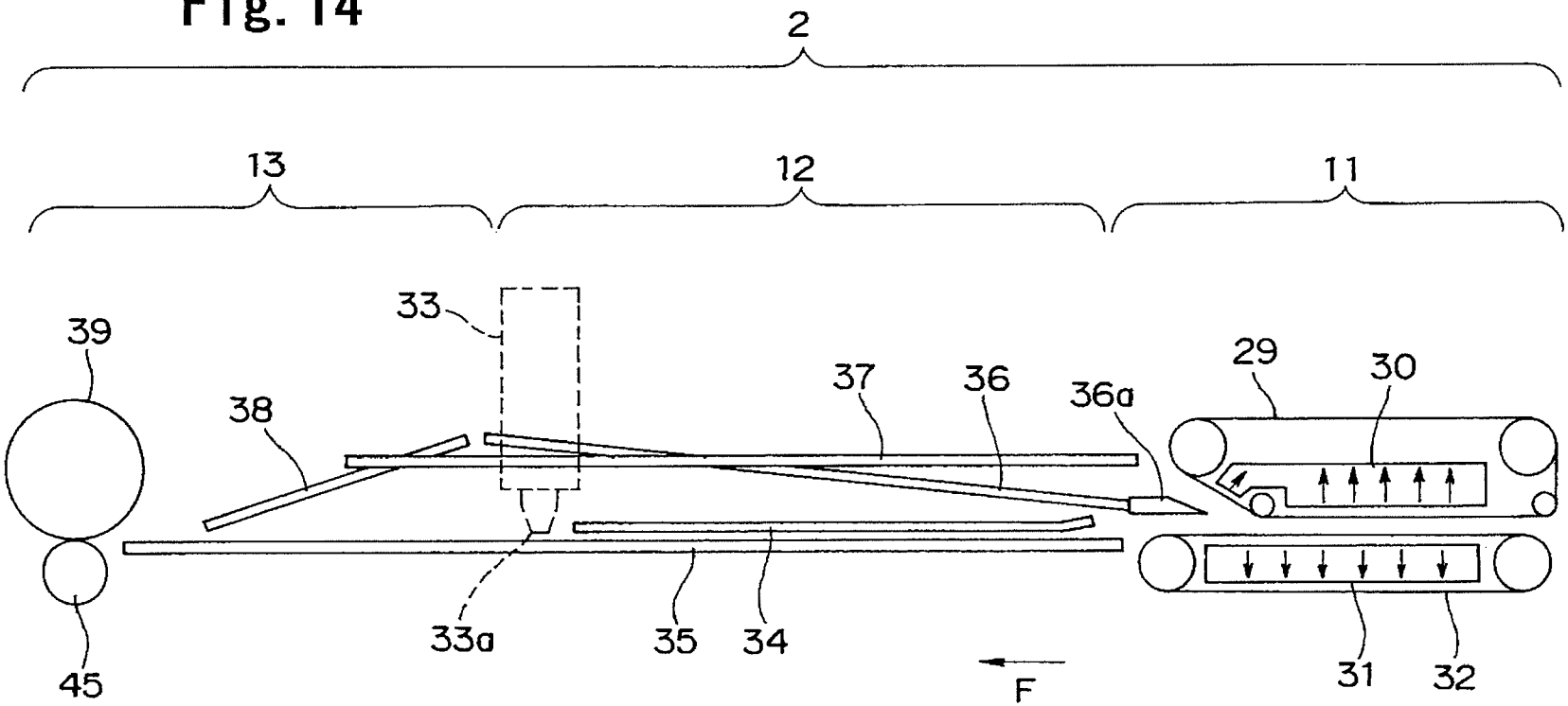
FIG. 14 shows a second embodiment of the present invention, and is a front view of a pasting main body.

FIG. 14 is a front view of a pasting main body 2 according to a second embodiment of the present invention. Air-suction type belt conveying mechanisms 29 and 32 respectively having upper and lower suction boxes 30 and 31 are disposed as an opening mechanism 11. Other structure is the same as that of the first embodiment, and the same elements are designated with the same symbols.

According to the second embodiment, even if a paper material of the sheet of paper P is soft and weak or thin, folded sheets of paper can be separated into upper and lower folded pieces and can be conveyed while keeping them from becoming wrinkled.

Third Embodiment

Figure 15:
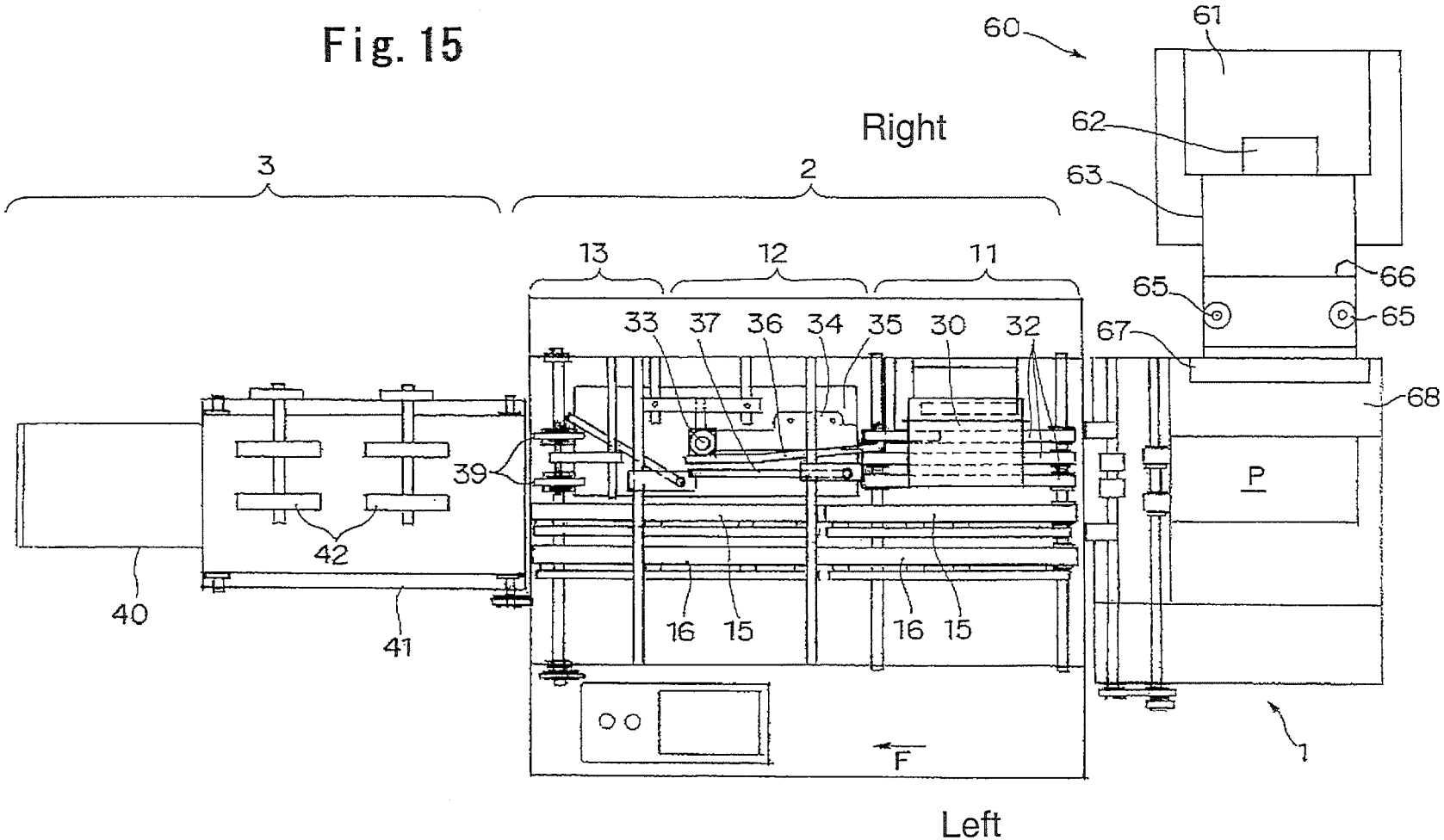
FIG. 15 shows a third embodiment of the present invention, and is a plan view of an entire apparatus for sealing paper with paste.
Figure 16:
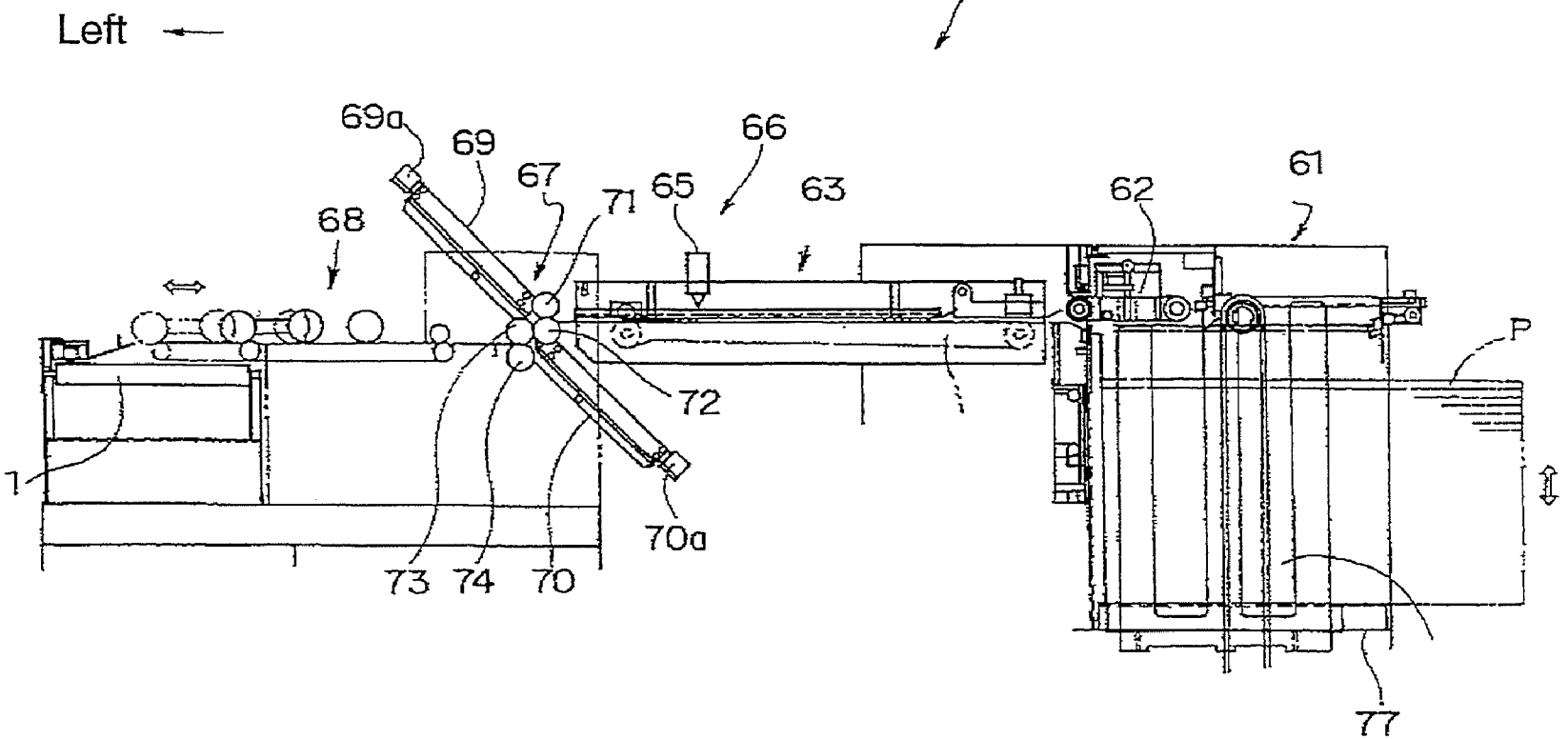
FIG. 16 is a schematic sectional view of a folder shown in FIG. 15.
Figure 17:
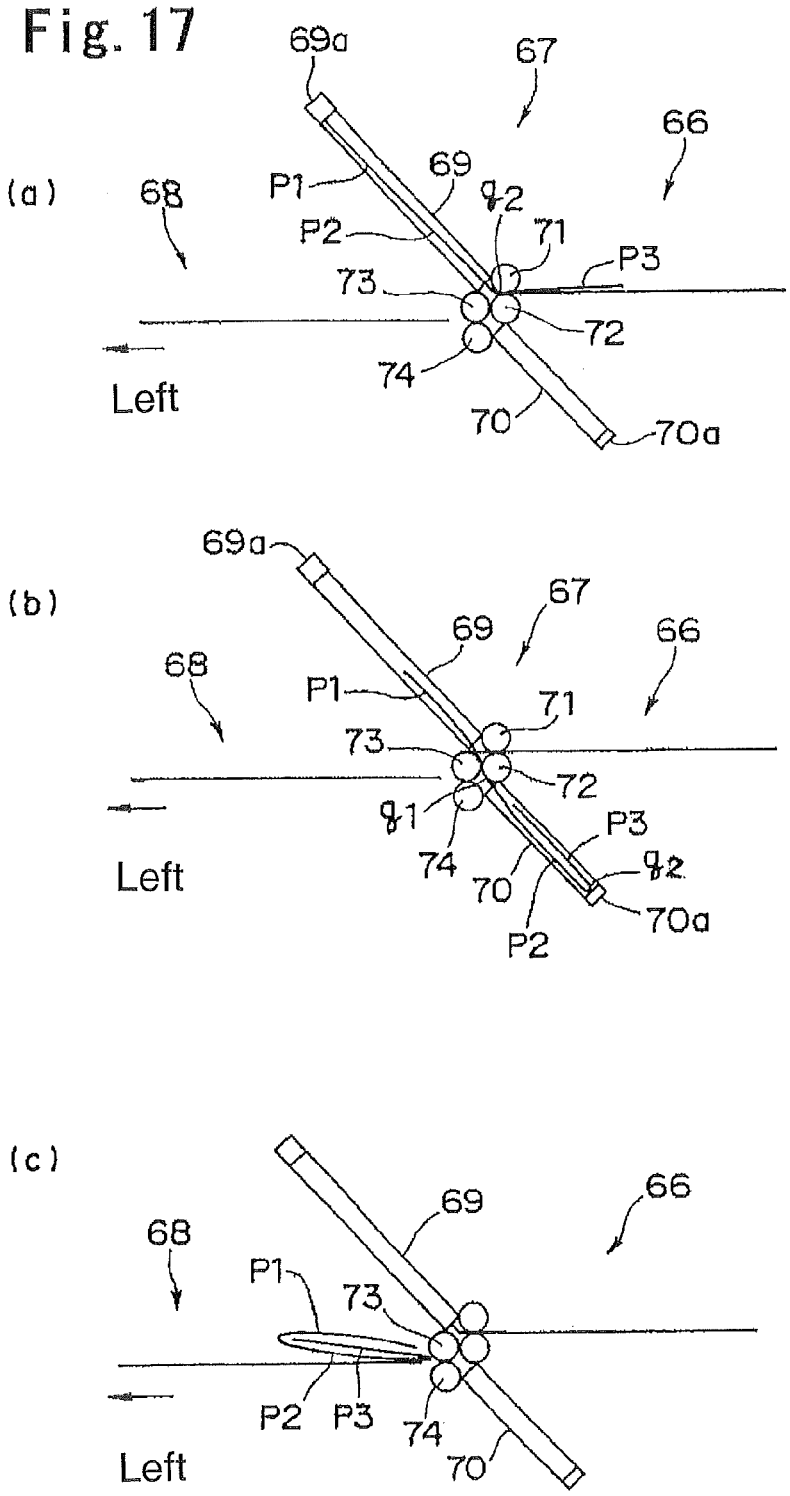
FIG. 17 are explanatory diagrams by rotation showing operations carried out by the folder shown in FIG. 15.

FIGS. 15 to 17 show an example in which paper folder 60 is connected to an apparatus for sealing paper with paste that is the same as that of the first embodiment shown in FIGS. 1 to 7.

In FIG. 15, a folder 60 is connected to a right side of a paper-feeding unit 1. This folder 60 has a well-known folder to which an additional adhesive applying mechanism 66 is added. A structure thereof will be briefly explained. The folder 60 includes a paper placing portion 61 on which non-folded sheets of paper are placed, a feeder portion 62 which sends out sheets of paper on the paper placing portion 61 one-sheet by one-sheet, a first conveying portion 63 which conveys the non-folded sheets of paper, and the adhesive applying mechanism 66 in which a pair of front and back applying nozzles 65 is disposed. The applying nozzles 65 apply a streaky temporary adhesive to front and rear ends of the sheet of paper that is being conveyed. The folder 60 also includes a folding portion 67 which folds the sheet of paper, and a second conveying portion 68 which conveys the folded sheet of paper to the paper-feeding unit 1 of the apparatus for sealing paper with paste, and carries the sheets of paper thereon.

In FIG. 16, the paper placing portion 61 includes a vertically movable placing stage 77, and the belt conveying type feeder portion 62 is disposed on an upper end of the paper placing portion 61. In FIG. 15, longitudinal positions of the front and rear applying nozzles 65 of the adhesive applying mechanism 66 can be adjusted, and the applying nozzles 65 are fixed to positions corresponding to front and rear ends of non-folded states of various kinds of the sheets of paper.

In FIG. 16, the folding portion 67 includes a pair of upper and lower folding trays 69 and 70, and first to fourth folding rollers 71, 72, 73 and 74 disposed between the upper and lower folding trays 69 and 70. Positions of stoppers 69*a* and 70*a* on tip ends of the folding trays 69 and 70 can be changed. The adjacent folding rollers 71 to 74 abut against each other, thereby forming nip portions.

The folding portion 67 is operated as shown in FIGS. 17(*a*) to (*c*) so that the sheet of paper P can be inwardly triple-folded as shown in FIG. 2. That is, as shown in FIG. 17(*a*), the sheet of paper P conveyed from the adhesive applying mechanism 66 is sent to the nip portion between the first and second folding rollers 71 and 72, and is sent into upper folding tray 69. A position of the stopper 69*a* of the upper folding tray 69 is set at a position corresponding to a total length of the first and second folded pieces P1 and p2. Therefore, after a tip end of the sheet of paper P abuts against the upper stopper 69*a* of the upper folding tray 69, when the sheet of paper is sent by the first and second folding rollers 71 and 72, the sheet of paper P is folded along the second bend line q2, a portion of the bend line q2 is sandwiched between the nip portions of the second folding roller 72 and the third folding roller 73, and the sheet of paper P is sent into the lower folding tray 70 as shown in FIG. 17(*b*).

Since the lower stopper 70*a* of the lower folding tray 70 is set at a position corresponding to a length of the second folded piece P2 (or third folded piece P3), after the second bend line q2 abuts against the stopper 70*a*, when the second bend line q2 is further sent by the third and fourth folding rollers 73 and 74, the sheet of paper is folded along the first bend line q1, the bend line q1 is sandwiched between the nip portions of the third folding roller 73 and the fourth folding roller 74, the sheet of paper is inwardly triple-folded as shown in FIG. 17(*c*), and the sheet of paper is sent to the second conveying portion 68. That is, the sheet of paper is folded along the first and second bend lines q1 and q2, the sheet of paper is inwardly triple-folded and is supplied to the second conveying portion 68.

In the third embodiment, the peelable temporary adhesive is applied, in a streaky form, to upper surfaces of the front and rear ends of the non-folded sheet of paper P by the adhesive applying mechanism 66 of the folder 60. The temporary adhesive after being applied is supplied to the paper-feeding unit 1 of the apparatus for sealing paper with paste in its non-folded state without being pressurized by the gouged folding roller or the pressing roller such as to avoid the applying portion, the temporary adhesive reaches the paper-receiving unit 3 shown in FIG. 15 in its substantially non-pressurized state, the temporary adhesive is pressurized by the auxiliary rollers 42 of the paper-receiving unit 3 and the front and rear ends of the sheet of paper P is finally temporarily adhered. Therefore, according to the third embodiment, the sheet of paper is pasted into a state where all of front, rear, left and right sides are sealed or bound.

Other Embodiments (1) When the triple-folded Z-shaped sheet of paper P as shown in FIG. 3 is to be pasted, according to the apparatus for sealing paper with paste of the first embodiment, the first folded piece P1 and the second folded piece P2 are pasted on each other and then, they are vertically reversed, the sheet of paper P is again supplied to the paper-feeding unit 1, and the pasting operation of the second folded piece P2 and the third folded piece P3 must be carried out as explained above. Alternatively, two sets of pasting main bodies 2 as shown in FIGS. 3 and 4 can be disposed in series in the paper conveying direction F, they are disposed in laterally opposite directions, one of the pasting main bodies 2 pastes the first folded piece P1 and the second folded piece P2 to each other, and the other pasting main body 2 pastes second folded piece P2 and third folded piece P3.

Figure 18:
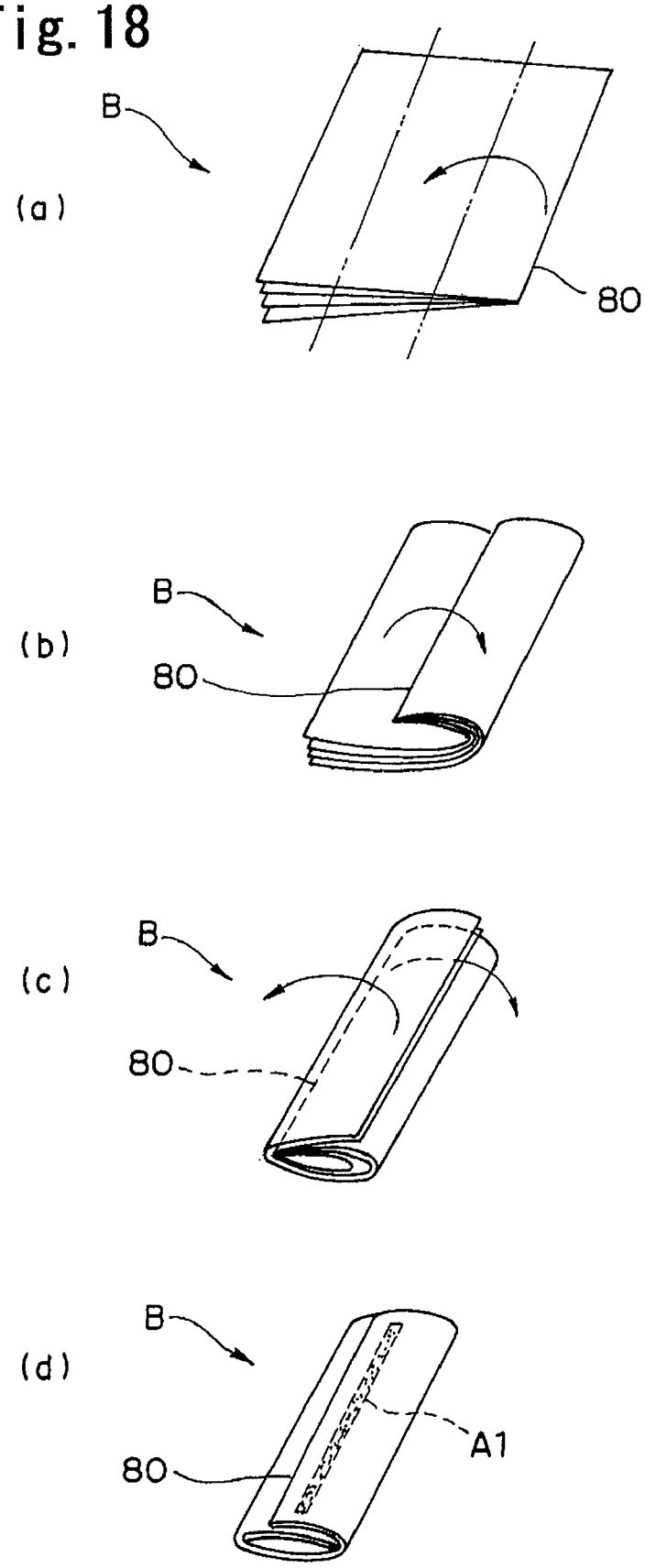
FIG. 18 are perspective views showing a booklet that can be pasted by the present invention, and shows states of a folding step and a pasting step.

(2) In addition to the sheets of paper shown in FIGS. 1 to 3, it is possible to employ the following sheet of paper. That is, a booklet B whose one end 80 is bound as shown in FIG. 18(*a*) is triple-folded such that a bound end 80 comes inward as shown in FIGS. 18(*b*) and (c) by the folder 60 shown in FIGS. 15 and 16 and then, upper and lower sides are switched such that the bound end 80 comes inward (downward) as shown in FIG. 18(*d*), and the temporary adhesive A1 is applied in a streaky form by the apparatus for sealing paper with paste as shown in FIGS. 1 to 4 and the sheet is sealed.

(3) Although the one applying nozzle 33 is disposed in the adhesive applying mechanism 12 and the temporary adhesive A1 is applied in one streaky line in the embodiment shown in FIGS. 4 to 7, two applying nozzles 33 may be disposed adjacently on left and right sides, and the adhesive can be applied in two streaky lines. With this, the adhering strength can be enhanced.

(4) When the temporary adhesive is applied in a streaky form by the applying nozzle 33, the temporary adhesive need not be applied continuously, and the temporary adhesive can be applied in a discontinuous broken line.

(5) A position of the applying nozzle 33 in the lateral direction can appropriately be changed in accordance with a position where the adhesive is applied. At that time, the position can be adjusted automatically utilizing a spring or can be adjusted manually.

(6) Although, the two paper detection sensors (S3 and S4) are disposed in said embodiments for starting and completing the application of the adhesive as shown in FIG. 5, it is also possible to control the start and completion of the application of the adhesive by using a single paper detection sensor. For example, the single paper detection sensor detects a tip end of the sheet of paper, counts the number of pulses in association with the conveying motor, thereby controlling the start and completion of the application.

(7) It is most preferable that positions of the upper and lower suction ports of the suction boxes of the opening mechanism are close to an end of the sheet of paper in the lateral direction.

(8) In the apparatus for sealing paper with paste of the present invention, a non-peelable adhesive can be used instead of the temporary adhesive. In this case, a sheet of paper can be perforated after the adhesive application processing. Alternatively, in the case of the third embodiment, a known slitter for perforating the sheet of paper can be disposed at a predetermined machining position, and the sheet of paper can be perforated simultaneously with the adhesive application processing.

(9) The present invention is not limited to the structures of the embodiment, and various modifications which can be conceived within a range not departing from contents described in claims are included in the invention.

What is claimed is:

1. An apparatus for sealing paper with paste which seals folded pieces of a folded sheet of paper by an adhesive, comprising a paper-feeding unit on which the folded sheets of paper are loaded and which supplies the sheets of paper one-sheet by one-sheet, a pasting main body which seals open ends of the sheet of paper supplied from the paper-feeding unit by means of an adhesive, and a paper-receiving unit on which the sealed sheets of paper discharged from the pasting main body are loaded, wherein the pasting main body comprises an opening mechanism which opens a closed sheet of paper in the vertical direction, an adhesive applying mechanism which applies, in a streaky form, a peelable temporary adhesive to an upper surface of an open end of a lower folded piece of the opened sheet of paper, a sealing mechanism which superposes an upper folded piece on the lower folded piece after application of the temporary adhesive, and which temporarily adheres open ends of the upper and lower folded pieces, and a conveying mechanism which conveys the sheet of paper from the opening mechanism to the sealing mechanism through the adhesive applying mechanism.

2. The apparatus for sealing paper with paste according to claim 1, wherein the opening mechanism comprises an upper suction portion which sucks the upper folded piece upward, and a lower suction portion which sucks the lower folded piece downward.

3. The apparatus for sealing paper with paste according to claim 2, wherein the upper suction portion is a suction box provided at its lower surface with a suction port, and the lower suction portion is an air-suction type belt conveying mechanism having a suction box provided at its upper surface with a suction port.

4. The apparatus for sealing paper with paste according to claim 2, wherein the upper suction portion is an air-suction type belt conveying mechanism having a suction box provided at its lower surface with a suction port, and the lower suction portion is an air-suction type belt conveying mechanism having a suction box provided at its upper surface with a suction port.

5. The apparatus for sealing paper with paste according to claim 1, further comprising an expansion guide member which guides the upper folded piece of the sheet of paper opened by the opening mechanism to the adhesive applying mechanism such that an opening degree of the folded piece is expanded, and a sealing guide member which guides, to the lower folded piece, the upper folded piece of the sheet of paper after the temporary adhesive is applied by the adhesive applying mechanism.

6. The apparatus for sealing paper with paste according to claim 1, wherein a folder which folds a non-folded sheet of paper and supplies the sheet of paper to the paper-feeding unit is connected to the paper-feeding unit.

7. The apparatus for sealing paper with paste according to claim 6, wherein the folder comprises an adhesive applying mechanism which applies, in a streaky form, a peelable temporary adhesive to an end of a non-folded sheet of paper in a direction of a bend line.

* * * * *